US007650720B2

(12) United States Patent
Ealer, Sr.

(10) Patent No.: US 7,650,720 B2
(45) Date of Patent: Jan. 26, 2010

(54) PERFORATED GUTTER PROTECTION SYSTEM HAVING CANALS

(76) Inventor: James E. Ealer, Sr., P.O. Box 188, St. Clair, MO (US) 63077

( * ) Notice: Subject to any disclaimer, the term of this patent is extended or adjusted under 35 U.S.C. 154(b) by 436 days.

(21) Appl. No.: 11/566,446

(22) Filed: Dec. 4, 2006

(65) Prior Publication Data

US 2008/0127575 A1 Jun. 5, 2008

(51) Int. Cl.
*E04D 13/00* (2006.01)

(52) U.S. Cl. ..... 52/12; 52/11; 210/498

(58) Field of Classification Search ..... 52/11, 52/12; 210/498; D23/261, 267; 4/510; 405/40; 404/4

See application file for complete search history.

(56) References Cited

U.S. PATENT DOCUMENTS

| | | | | |
|---|---|---|---|---|
| 891,406 | A | 6/1908 | Cassens | |
| 1,597,503 | A | 8/1926 | Andrews | |
| 2,022,255 | A * | 11/1935 | Scott | 52/585.1 |
| 2,175,521 | A | 10/1939 | Fry | |
| 2,209,741 | A | 7/1940 | Sullivan et al. | |
| 2,271,081 | A | 1/1942 | Layton | |
| 2,988,226 | A | 6/1961 | Campbell | |
| 3,067,881 | A | 12/1962 | Goosmann | |
| 3,108,406 | A | 10/1963 | Ellis | |
| 3,351,206 | A | 11/1967 | Wennerstrom | |
| 3,388,555 | A | 6/1968 | Foster | |
| 3,774,274 | A | 11/1973 | Jury | |
| 3,950,951 | A | 4/1976 | Zukauskas | |
| 4,307,976 | A | 12/1981 | Butler | |
| 4,418,504 | A | 12/1983 | Lassiter | |
| 4,631,875 | A | 12/1986 | Olson | |
| 4,695,033 | A * | 9/1987 | Imaeda et al. | 249/189 |
| 4,727,689 | A | 3/1988 | Bosler | |
| 4,750,300 | A | 6/1988 | Winger, Jr. | |

(Continued)

FOREIGN PATENT DOCUMENTS

DE 3905961 9/1989

(Continued)

OTHER PUBLICATIONS

Office Action dated Oct. 24, 2007, U.S. Appl. No. 11/105,653, 24 pages.

(Continued)

*Primary Examiner*—Robert J Canfield
*Assistant Examiner*—Christine T Cajilig
(74) *Attorney, Agent, or Firm*—Senniger Powers LLP

(57) ABSTRACT

A gutter protection system is adapted for covering a gutter and preventing debris from falling into the gutter. The gutter protection system comprises an elongate sheet metal member or panel adapted to engage a portion of the gutter and to cover the gutter. The sheet metal member has a longitudinal axis and a generally smooth top surface interrupted by a plurality of canals and perforations formed therein. Each canal extends down and away from the smooth top surface. The canals are formed from the material of the sheet metal member, each canal formed so that water entering the canal exits through one of the perforations and flows into the gutter below. The canals enable water to move laterally within the canal, thereby increasing the water volume handled by the system without necessarily increasing the number of holes or perforations.

18 Claims, 7 Drawing Sheets

U.S. PATENT DOCUMENTS

| | | | | | |
|---|---|---|---|---|---|
| 4,769,957 | A | | 9/1988 | Knowles | |
| 4,796,390 | A | | 1/1989 | Demartini | |
| 4,841,686 | A | | 6/1989 | Rees | |
| 4,905,427 | A | | 3/1990 | McPhalen | |
| 4,907,381 | A | | 3/1990 | Ealer | |
| 4,936,061 | A | | 6/1990 | Palma | |
| 4,937,986 | A | | 7/1990 | Way, Sr. et al. | |
| 4,941,299 | A | | 7/1990 | Sweers | |
| D310,259 | S | * | 8/1990 | Hitchins | D23/267 |
| 5,010,696 | A | * | 4/1991 | Knittel | 52/12 |
| 5,072,551 | A | | 12/1991 | Manoogian, Jr. | |
| 5,092,086 | A | | 3/1992 | Rognsvoog, Sr. | |
| 5,095,666 | A | | 3/1992 | Williams, Jr. | |
| 5,103,601 | A | | 4/1992 | Hunt | |
| 5,109,640 | A | | 5/1992 | Creson | |
| 5,251,410 | A | | 10/1993 | Carey | |
| 5,271,191 | A | | 12/1993 | Vahamaki | |
| 5,271,192 | A | | 12/1993 | Nothum, Sr. et al. | |
| 5,406,754 | A | | 4/1995 | Cosby | |
| 5,438,803 | A | | 8/1995 | Blizard, Jr. | |
| 5,522,183 | A | | 6/1996 | Allen | |
| 5,619,825 | A | | 4/1997 | Leroney et al. | |
| 5,709,051 | A | | 1/1998 | Mazziotti | |
| 5,813,173 | A | | 9/1998 | Way, Sr. | |
| 5,842,311 | A | | 12/1998 | Morin | |
| 5,893,240 | A | | 4/1999 | Ealer, Sr. | |
| 6,151,836 | A | | 11/2000 | McGlothlin | |
| 6,151,837 | A | | 11/2000 | Ealer, Sr. | |
| 6,568,132 | B1 | | 5/2003 | Walters | |
| 6,598,352 | B2 | | 7/2003 | Higginbotham | |
| 6,883,760 | B2 | | 4/2005 | Seise, Jr. | |
| 6,941,707 | B2 | * | 9/2005 | Sigmund | 52/95 |
| 6,951,077 | B1 | | 10/2005 | Higginbotham | |
| D523,538 | S | | 6/2006 | Brochu | |
| 2002/0020125 | A1 | * | 2/2002 | Pelfrey et al. | 52/302.1 |
| 2005/0210758 | A1 | * | 9/2005 | Iannelli | 52/11 |
| 2005/0257432 | A1 | * | 11/2005 | Higginbotham | 52/12 |
| 2006/0101722 | A1 | | 5/2006 | Ealer, Sr. | |
| 2006/0123710 | A1 | * | 6/2006 | Lenney et al. | 52/12 |
| 2006/0201068 | A1 | | 9/2006 | Shane | |
| 2006/0230687 | A1 | | 10/2006 | Ealer, Sr. | |
| 2006/0265968 | A1 | * | 11/2006 | Lowrie | 52/11 |

FOREIGN PATENT DOCUMENTS

| | | | | |
|---|---|---|---|---|
| DE | 3829384 | | | 3/1990 |
| JP | 11264160 | A | * | 9/1999 |

OTHER PUBLICATIONS

Office action regarding U.S. Appl. No. 11/567,919; 17 pages.

* cited by examiner

PERFORATED GUTTER PROTECTION SYSTEM HAVING CANALS

FIELD OF THE INVENTION

The present invention relates generally to rain gutters and more particularly to a gutter protection system for such gutters.

BACKGROUND OF THE INVENTION

Gutter protection systems such as gutter screens attempt to direct water into the gutter while preventing debris from entering the gutter. The screen should be designed so that it does not itself become clogged with debris and is securely attached to the gutter. However, some conventional gutter screens have holes that often trap debris instead of allowing the debris to slide over the screen. Debris may build up in the holes and cause rainwater to bypass the holes and flow over the gutter instead of into the gutter, or may cause rainwater to build up above the gutter. The debris must thereafter be removed from the screens by hand. Thus, many conventional gutter screens are not maintenance free. Moreover, the pattern of holes in prior art gutter screens is such that, even without debris clogging, water may flow along a path that avoids all the holes in the screen and thereby flows over the screen and gutter. In other words, water is not satisfactorily directed by the gutter screen into the gutter. Accordingly, a cost-effective, maintenance-free gutter screen that directs ample rainwater to flow into the gutter is needed.

SUMMARY OF THE INVENTION

In one aspect of the invention, a gutter protection system is adapted for covering a gutter and preventing debris from falling into the gutter. The gutter protection system comprises an elongate sheet metal member sized and shaped to engage a portion of the gutter and to cover the gutter. The sheet metal member has a longitudinal axis and a generally smooth top surface interrupted by a plurality of canals and perforations formed in the canals. The canals and perforations extend generally parallel to the axis. Each canal extends down and away from the smooth top surface. The canals are aligned in continuous rows extending parallel to the axis. A continuous, uninterrupted and unbroken portion of the top surface extends between adjacent canals. The canals are formed from the material of the sheet metal member, each canal formed so that water entering the canal can move laterally within the canal and exit through one of the perforations to flow into the gutter below. The system can thereby handle a higher volume of water without increasing the number of perforations. The canals and perforations are formed so that debris is inhibited from being trapped in the canals or in the perforations.

Various refinements exist of the features noted in relation to the above-mentioned aspects of the present invention. Further features may also be incorporated in the above-mentioned aspects of the present invention as well. These refinements and additional features may exist individually or in any combination. For instance, various features discussed below in relation to any of the illustrated embodiments of the present invention may be incorporated into any of the above-described aspects of the present invention, alone or in any combination.

BRIEF DESCRIPTION OF THE DRAWINGS

Corresponding reference characters indicate corresponding parts throughout the drawings.

DETAILED DESCRIPTION OF THE DRAWINGS

Figure 1:
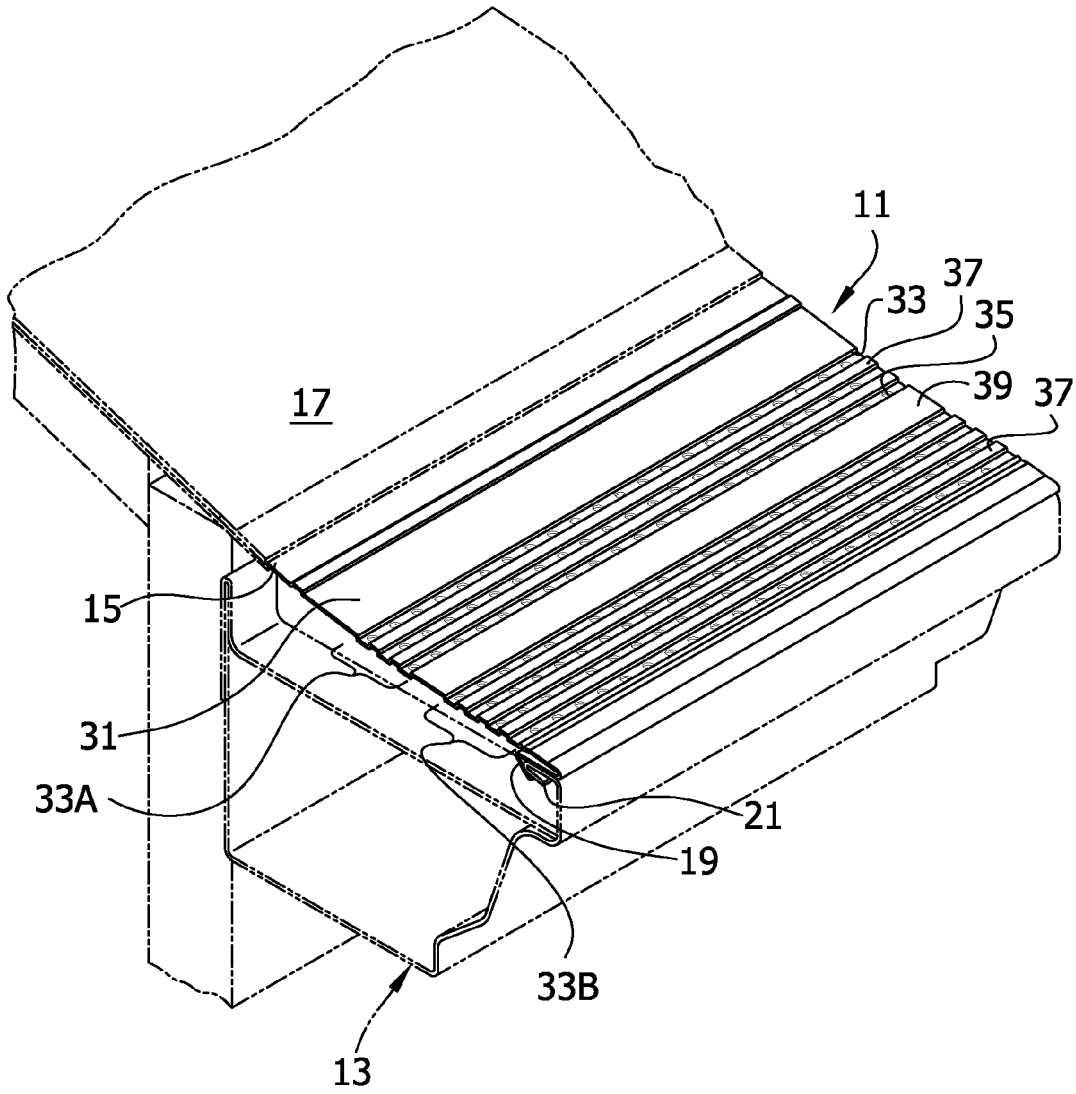
FIG. 1 is a perspective of a gutter screen of one embodiment as mounted on a gutter.
Figure 2:
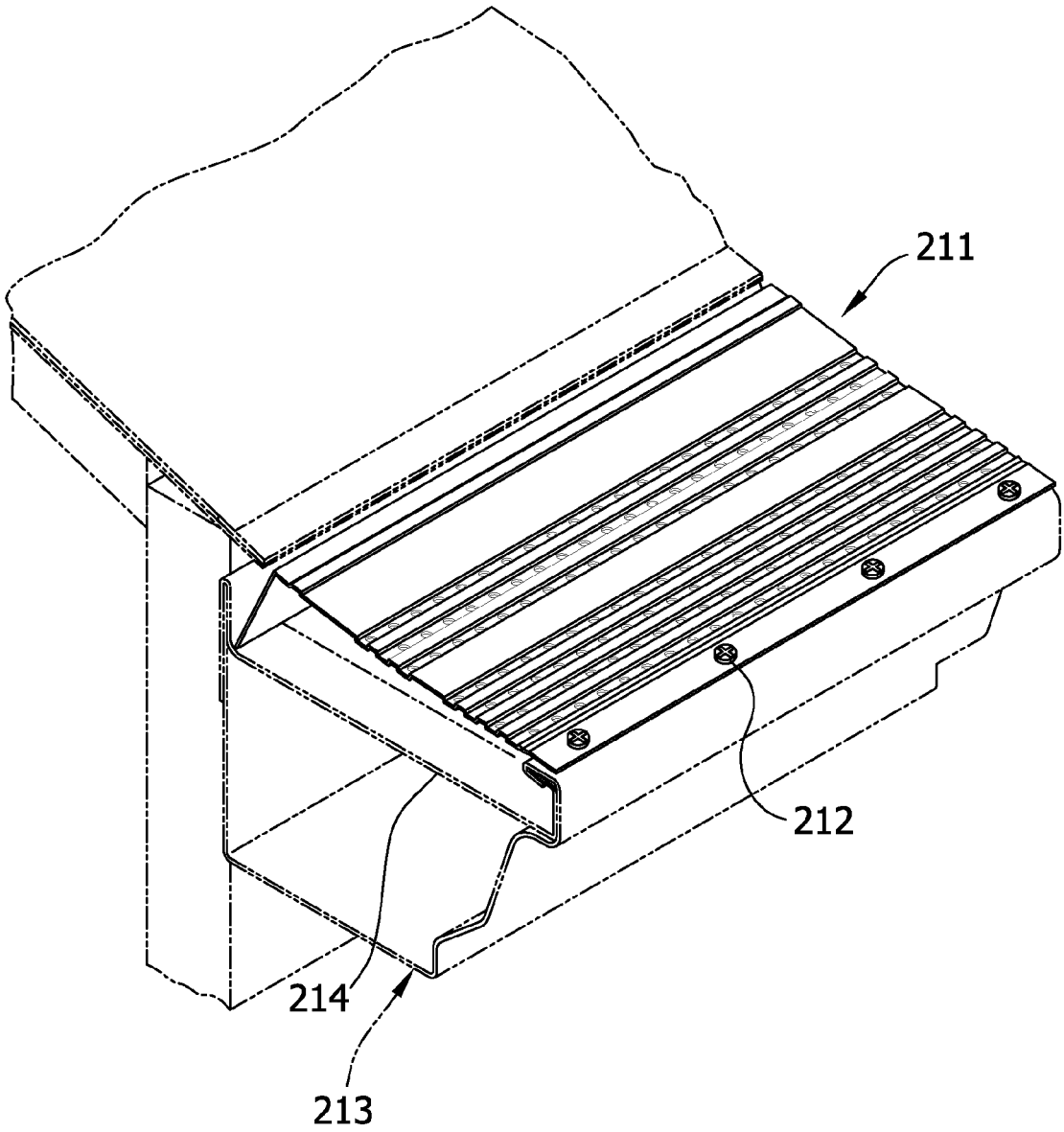
FIG. 2-4 are perspectives of screens similar to FIG. 1 but showing alternative attachment configurations.
Figure 3:
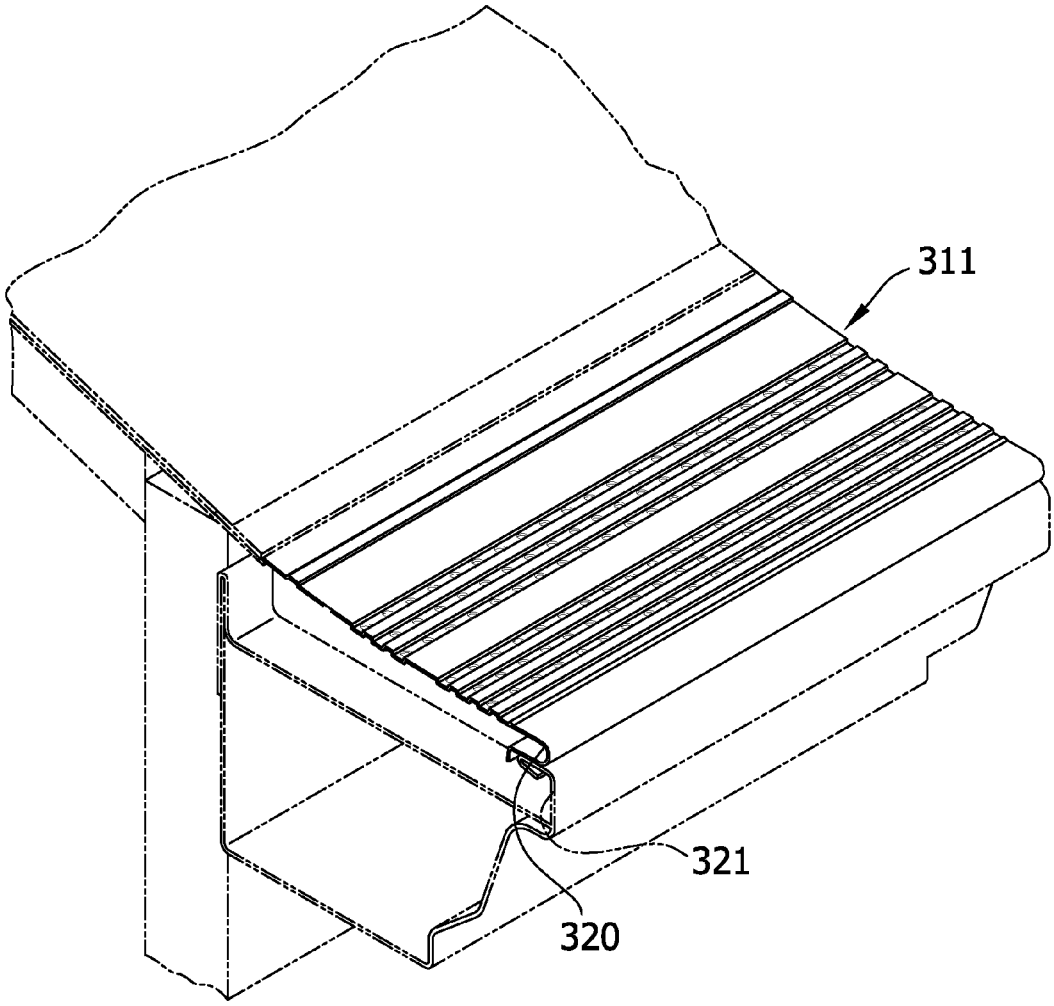
Figure 4:
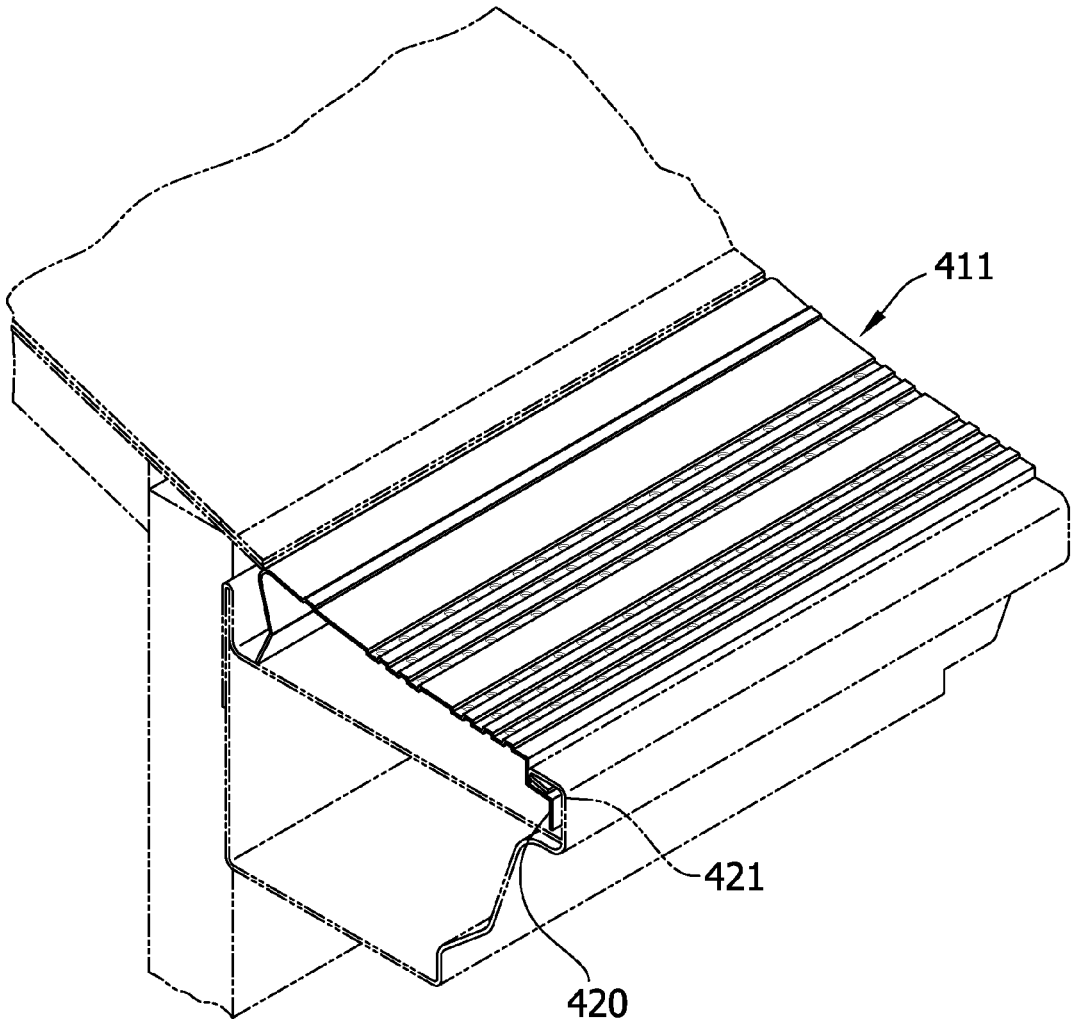

Referring to FIG. 1, a screen 11 (broadly, gutter protection system) of one embodiment is generally adapted for covering a gutter 13 and preventing debris from falling into the gutter. The screen 11 of the FIG. 1 embodiment has a generally flat rear section 15 that slips under a shingle 17 of the roof and has a V-shaped bend 19 in front that engages a front flange 21 of the gutter. In this way, the screen 11 engages a portion of the gutter 13 and covers the gutter. However, the screen can be attached to the gutter in any number of ways. Examples of alternative attachment configurations are shown in FIGS. 2-4. In FIG. 2, screws 212 secure the front of the screen 211, and the rear of the screen has a downward bend to engage a gutter hanger 214. In FIG. 3, the front of the screen 311 has a U-shaped bend 320 and rests on the front flange 321 of the gutter. In FIG. 4, the front of screen 411 has a stair-step bend 420 that engages the underside of the front flange 421 of the gutter, and a compound bend at the rear. Other alternatives not shown herein are contemplated within the scope of the invention. Some other alternatives are shown in U.S. Pat. Nos. 6,151,837; 5,893,240; 4,907,381; and U.S. patent application Ser. Nos. 11/105,653 and 10/987,930, all of which are incorporated herein by reference. The gutter protection system may include other components, such as clips, within the scope of the invention.

Figure 5:
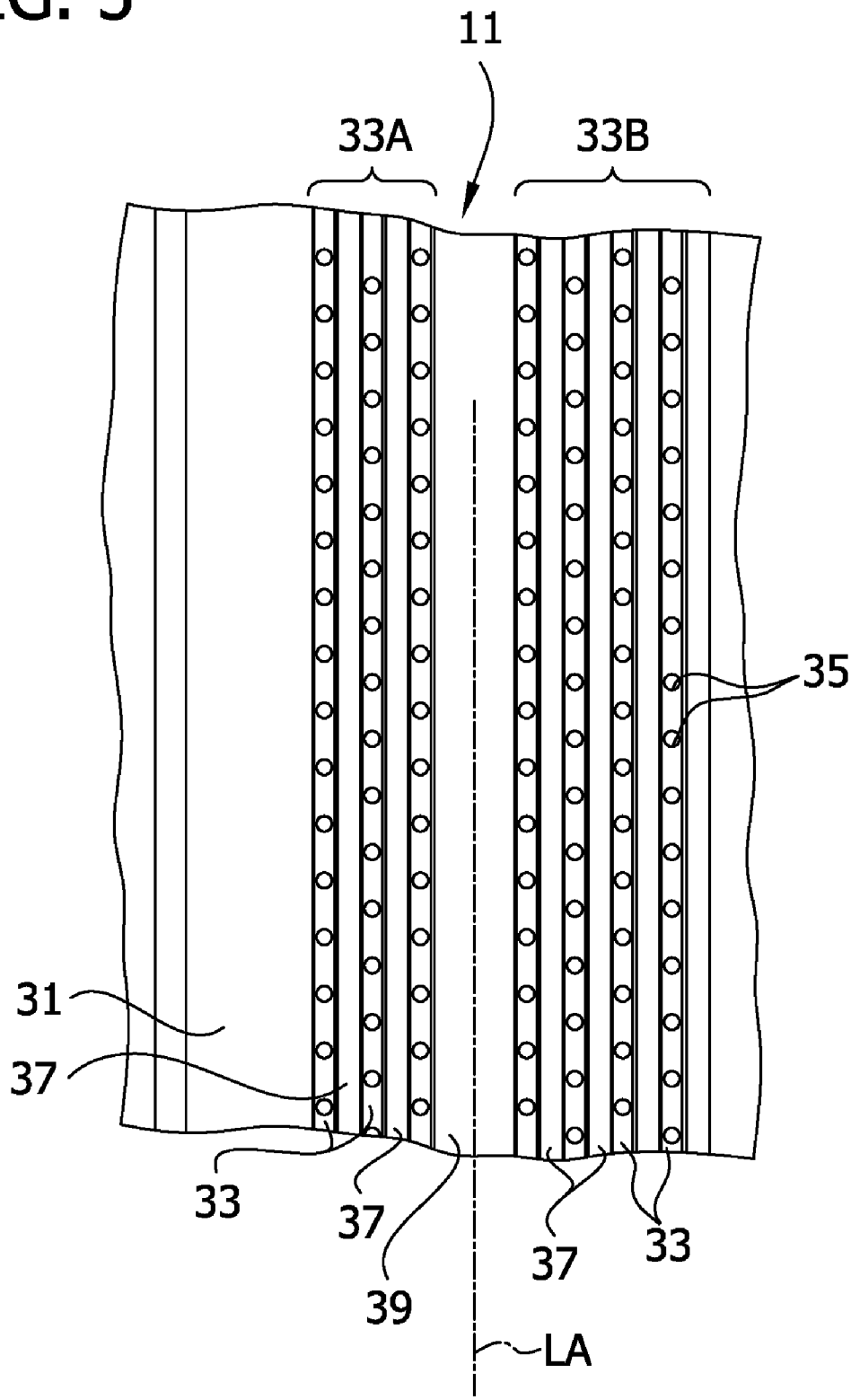
FIG. 5 is a top view of the gutter screen of FIG. 1.

The screens 11, 211, 311, 411 shown herein are generally of one piece, integral construction. Each screen is an elongate sheet metal member or panel having a longitudinal axis LA (FIG. 5) and a generally smooth top surface interrupted by a plurality of canals 33 and perforations 35 formed therein.

The canals 33 and perforations 35 run generally parallel to the longitudinal axis LA. The canals 33 are aligned in continuous rows extending parallel to the axis LA. A continuous, uninterrupted and unbroken portion of the top surface extends between adjacent canals 33. As illustrated in FIGS. 1-6, the canals 33 include a first upstream set of canals 33A and a second downstream set of canals 33B. The canals in each set 33A, 33B are separated by relatively narrow, generally co-planar flat sections 37 of the top surface of the sheet metal member. The upstream set of canals 33A is spaced from the downstream set of canals 33B by a wider flat section 39 generally co-planar with the narrow flat sections 37.

Figure 6:
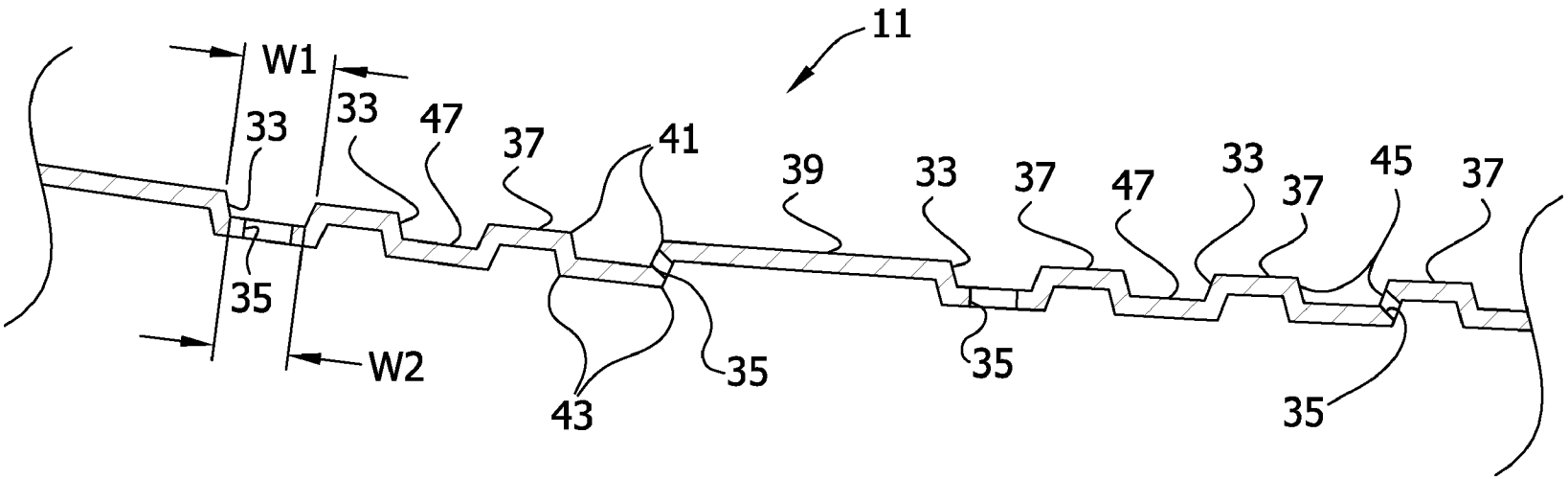
FIG. 6 is a cross section of the gutter screen.

Each canal 33 extends downward and away from the smooth top surface. Each canal 33 is integrally formed from the material of the sheet metal member. Generally, each canal 33 is formed so that water enters the canal and so that debris is inhibited from entering the canal. As shown in FIG. 6 in cross-section, each canal 33 is formed by two upper bends 41 and two lower bends 43 so that the canal has opposing side walls 45 which converge downwardly toward a generally flat bottom wall 47. In this embodiment, each canal has a depth between 0.06 and 0.38 inches, or even between 0.1 and 0.2 inches. Each canal has an opening width W1 between 0.12 and 0.75 inches, or more particularly, each canal has an opening width between 0.2 and 0.3 inches. Generally, the wider the opening width, the more water that will enter the canal. But the wider width also may allow more debris to enter the canal. Each canal has a bottom width W2 between 0.06 and 0.63 inches or more particularly a bottom width between 0.1 and 0.2 inches. The bottom width W2 of the canal may determine the maximum width of the perforations.

The canals of this embodiment extend the full length of the sheet metal member. The canals may be formed using a roll former or other suitable machine. The canals may be formed using a solid die. The member is typically 36-48 inches long for ease of installation, though other lengths are contemplated within the scope of the invention.

The perforations may be formed only in the bottom of each canal, or formed in the bottom and in the walls of the canal as shone in FIG. 6. The perforations may be spaced apart in a repeating pattern so that there is equal space between each adjacent perforation. A typical spacing between perforations is about 0.25 inches. The perforations continue in this pattern for the full length of the canal.

Figure 7:
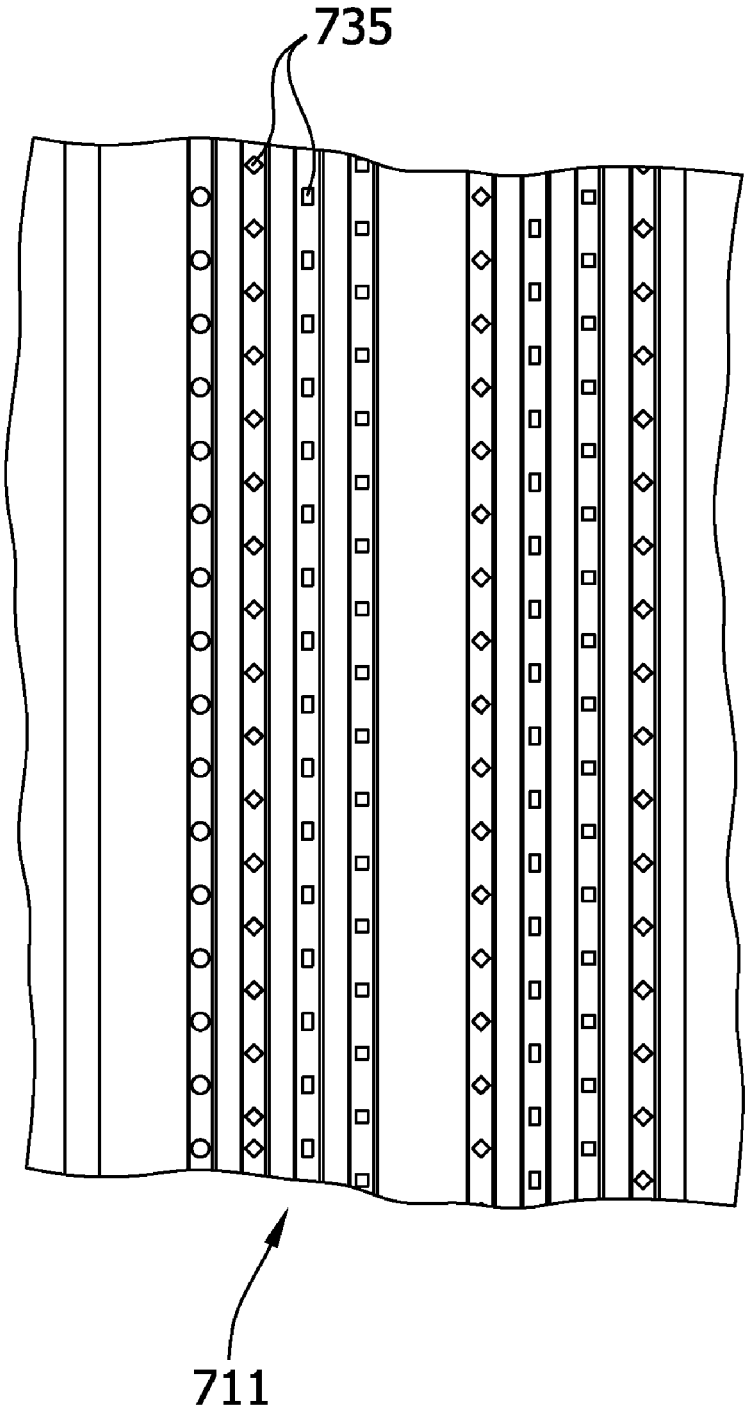
FIG. 7 is a top view of a screen of another embodiment.

The perforations of the FIGS. 1-6 embodiments have a round shape. In the screen 711 shown in FIG. 7, the perforations 735 also have diamond, rectangular and square shapes. Other shapes are contemplated within the scope of the invention. The perforations are appropriately sized to promote water flow through the perforations, while being sufficiently small so that debris is inhibited from entering the perforation. The perforations can be made by a roller, a punch or other suitable methods.

As noted above, each canal is formed so that water entering the canal exits through one of the perforations and flows into the gutter. The water can flow side-to-side or laterally within the canal until it flows through one of the perforations. In this way, water cannot avoid flowing into the gutter by flowing between holes, as sometimes happens in prior art screens. The canal and perforations of this invention may be appropriately sized so that debris is not trapped in the canal or in one the perforations. Thus as water flows from the rear of the screen towards the front, the water will flow into one of the canals and through one of the perforations therein. The water may flow directly into the perforation, or may move laterally in the canal until it falls through a perforation. As noted above, the prior art screens do not include a canal for indirect, lateral or side-to-side flow. The canals of this invention increase the water volume that the screen can "handle" or direct into the gutter. In other words, the water can move left or right within the canal and through a perforation, thereby increasing the water volume "available" to the perforations. Thus, there is less chance that any water will flow over the screen and not go into the gutter. Also, the systems of the invention can have the same relative number or area of perforations as prior art screens, while handling more water than prior art screens. The shape of the canals also forces debris to pass over the canals and perforations, rather than into them.

When introducing elements of various aspects of the present invention or embodiments thereof, the articles "a", "an", "the" and "said" are intended to mean that there are one or more of the elements. The terms "comprising", "including" and "having" are intended to be inclusive and mean that there may be additional elements other than the listed elements. Moreover, the use of "top" and "bottom", "front" and "rear", "above" and "below" and variations of these and other terms of orientation is made for convenience, but does not require any particular orientation of the components.

As various changes could be made in the above constructions, products, and methods without departing from the scope of the invention, it is intended that all matter contained in the above description or shown in the accompanying drawings shall be interpreted as illustrative and not in a limiting sense.

What is claimed is:

1. A roof gutter protection system for covering a roof gutter and preventing debris from falling into the roof gutter, the gutter protection system comprising:

an elongate sheet metal member sized and shaped to engage a portion of the gutter and to cover the gutter, the member having a longitudinal axis and a generally smooth top surface interrupted by a plurality of canals and perforations formed therein, the canals and perforations extending generally parallel to the axis, each canal extending down and away from the smooth top surface, the canals being aligned in continuous rows extending parallel to the axis, a continuous, uninterrupted and unbroken portion of the top surface extending between adjacent canals, the canals being formed from the material of the sheet metal member, each canal formed so that water entering the canal exits through one of the perforations and flows into the roof gutter, the canal and perforations formed so that debris is not trapped in the canal and the perforation, said canals including a first upstream set of canals and a second downstream set of canals, the canals in each set being separated by generally co-planar flat sections of said top surface, and the upstream set of canals being spaced from the downstream set of canals by a flat section of said top surface which is wider than the flat sections between the canals of each set of canals, said wider flat section being generally co-planar with the flat sections between the canals of each set of canals.

2. The roof gutter protection system as set forth in claim 1 wherein each canal having opposing side walls converging downward toward a flat bottom wall.

3. The roof gutter protection system as set forth in claim 2 wherein the perforations are only formed in a bottom of each canal, the perforations being spaced apart in a repeating pattern the full length of the canal and the member.

4. The roof gutter protection system as set forth in claim 3 wherein the perforations have one of the following shapes: round, diamond, rectangular and square.

5. The roof gutter protection system as set forth in claim 1 wherein each canal has a depth between 0.06 and 0.38 inches.

6. The roof gutter protection system as set forth in claim 1 wherein each canal has a depth between 0.1 and 0.2 inches.

7. The roof gutter protection system as set forth in claim 5 wherein each canal has an opening width between 0.12 and 0.75 inches.

8. The roof gutter protection system as set forth in claim 6 wherein each canal has an opening width between 0.2 and 0.3 inches.

9. The roof gutter protection system as set forth in claim 7 wherein each canal has a bottom width between 0.06 and 0.63 inches.

10. The roof gutter protection system as set forth in claim 8 wherein each canal has a bottom width between 0.1 and 0.2 inches.

11. The roof gutter protection system as set forth in claim 1 in combination with the gutter.

12. A roof gutter and gutter protection system for preventing debris from falling into the gutter and allowing water to flow into the gutter, the gutter protection system comprising:

an elongate panel sized and shaped to engage a portion of the roof gutter and to cover the roof gutter, the panel having a generally smooth top surface interrupted by a plurality of canals and perforations formed therein, each canal extending down and away from the smooth top surface, each canal having opposing side walls converging downward toward a flat bottom wall, the canals being aligned in continuous rows, and a continuous, uninterrupted and unbroken portion of the top surface extending between adjacent canals, the canals being formed from the material of the panel, each canal formed so that water entering the canal exits through one of the perforations and flows into the roof gutter, the canal and perforations formed so that debris is not trapped in the canal and the perforation said canals including a first upstream set of canals and a second downstream set of canals, the canals in each set being separated by generally co-planar flat sections of said top surface, and the upstream set of canals being spaced from the downstream set of canals by a flat section of said top surface which is wider than the flat sections between the canals of each set of canals, said wider flat section being generally co-planar with the flat sections between the canals of each set of canals.

13. The roof gutter and gutter protection system of claim 12 wherein the elongate panel has a longitudinal axis and the canals and perforations extend generally parallel to the axis.

14. The roof gutter and gutter protection system as set forth in claim 12 wherein the perforations are only formed in a bottom of each canal, the perforations being spaced apart in a repeating pattern the full length of the canal and the panel.

15. The roof gutter and gutter protection system as set forth in claim 12 wherein the perforations have one of the following shapes: round, diamond, rectangular and square.

16. The roof gutter and gutter protection system as set forth in claim 12 wherein the perforations are formed in a wall of each canal.

17. A roof gutter protection system for covering a roof gutter and preventing debris from falling into the roof gutter, the gutter protection system comprising:

an elongate member sized and shaped to engage a portion of the gutter and to cover the gutter, the member having a longitudinal axis and a generally smooth top surface interrupted by a plurality of canals and perforations formed therein, the canals and perforations extending generally parallel to the axis, each canal extending down and away from the smooth top surface, the canals being aligned in continuous rows extending parallel to the axis, a continuous, uninterrupted and unbroken portion of the top surface extending between adjacent canals, the canals being formed from the material of the member, each canal formed so that water entering the canal exits through one of the perforations and flows into the roof gutter, the canal and perforations formed so that debris is not trapped in the canal and the perforation, said canals including a first upstream set of canals and a second downstream set of canals, the canals in each set being separated by generally co-planar flat sections of said top surface, and the upstream set of canals being spaced from the downstream set of canals by a flat section of said top surface which is wider than the flat sections between the canals of each set of canals, said wider flat section being generally co-planar with the flat sections between the canals of each set of canals.

18. The roof gutter protection system as set forth in claim 17 wherein each canal has opposing side walls converging downward toward a flat bottom wall, and each canal has an opening width of between 0.12 and 0.75 in.

* * * * *

UNITED STATES PATENT AND TRADEMARK OFFICE

CERTIFICATE OF CORRECTION

PATENT NO. : 7,650,720 B2
APPLICATION NO. : 11/566446
DATED : January 26, 2010
INVENTOR(S) : James E. Ealer, Sr.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 489 days.

Signed and Sealed this

Twenty-third Day of November, 2010

David J. Kappos

David J. Kappos
*Director of the United States Patent and Trademark Office*